United States Patent [19]

Hinds et al.

[11] 4,437,985

[45] Mar. 20, 1984

[54] CONTAINER DEFECT MONITORING SYSTEM

[75] Inventors: James J. Hinds, LeGrange; John C. Hoeflich; George C. Kolodziej, both of Oak Park, all of Ill.

[73] Assignee: National Can Corporation, Chicago, Ill.

[21] Appl. No.: 264,798

[22] Filed: May 18, 1981

[51] Int. Cl.[3] ..... B07C 5/02; B07C 5/342

[52] U.S. Cl. ..... 209/538; 198/345; 209/528; 209/541; 209/580; 356/428

[58] Field of Search ..... 209/522, 523, 524, 528, 209/540, 541, 542, 545, 552, 576, 577, 578, 580, 587, 905; 356/426, 428; 364/579, 580; 198/339, 345, 346

[56] References Cited

U.S. PATENT DOCUMENTS

| | | | |
|---|---|---|---|
| 2,742,151 | 4/1956 | Milford | 209/538 |
| 3,356,212 | 12/1967 | Landin | 209/538 X |
| 3,417,241 | 12/1968 | Davis | 209/524 X |
| 3,637,074 | 1/1972 | Banyas et al. | 209/905 X |
| 4,074,130 | 2/1978 | Messman et al. | 356/428 X |
| 4,144,960 | 3/1979 | Scourtes | 198/339 |
| 4,248,389 | 2/1981 | Thompson et al. | 209/538 X |
| 4,266,651 | 5/1981 | Ström | 198/345 |

*Primary Examiner*—Robert B. Reeves
*Assistant Examiner*—Edward M. Wacyra
*Attorney, Agent, or Firm*—Robert A. Stenzel; Ralph R. Rath

[57] ABSTRACT

A color monitoring device includes a mechanism for removing containers from a path and accurately positioning a preselected area with a color monitor. The color monitor produces an output signal representative of the area being monitored which is amplified and fed to a computer where it is compared with reference signals. If the output signal is outside prescribed limits, the container is rejected, and if it is within prescribed limits, the container is returned to the path. A shuttle mechanism is activated by the computer and automatically removes a container from the path while returning a previously inspected container to the path. Stepper motors are used to vertically and horizontally position a selected point in front of the colorimeter.

22 Claims, 13 Drawing Figures

20
30
B
32
28
C
24
22
26
33

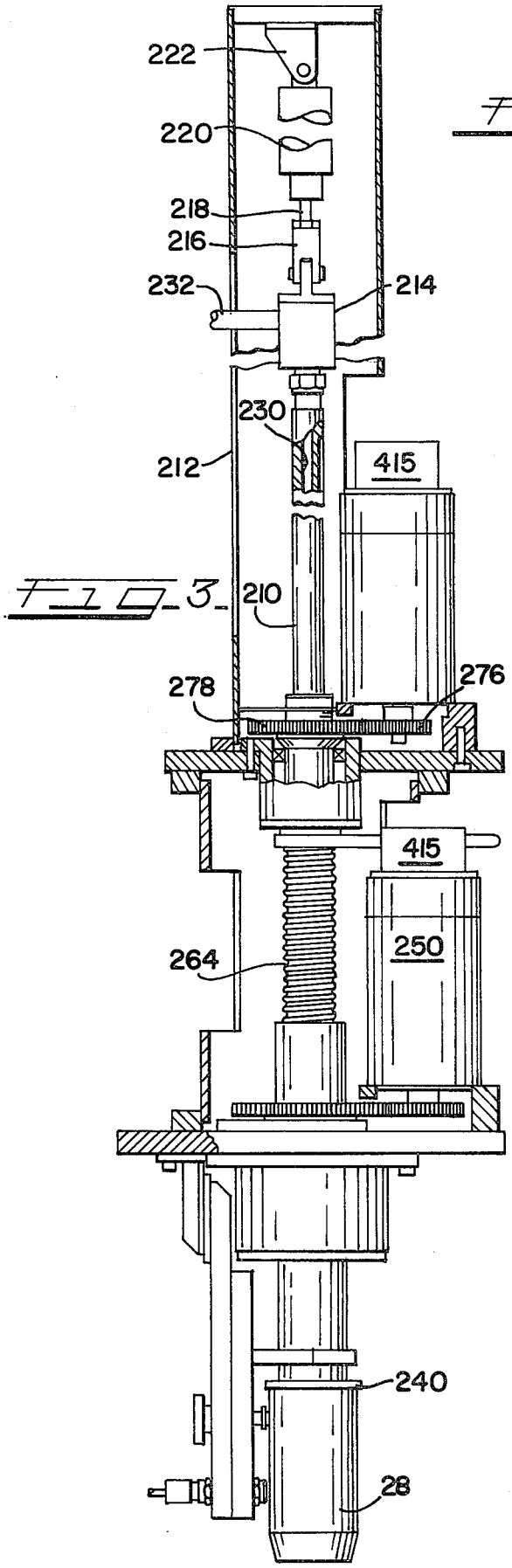
FIG. 3
FIG. 4
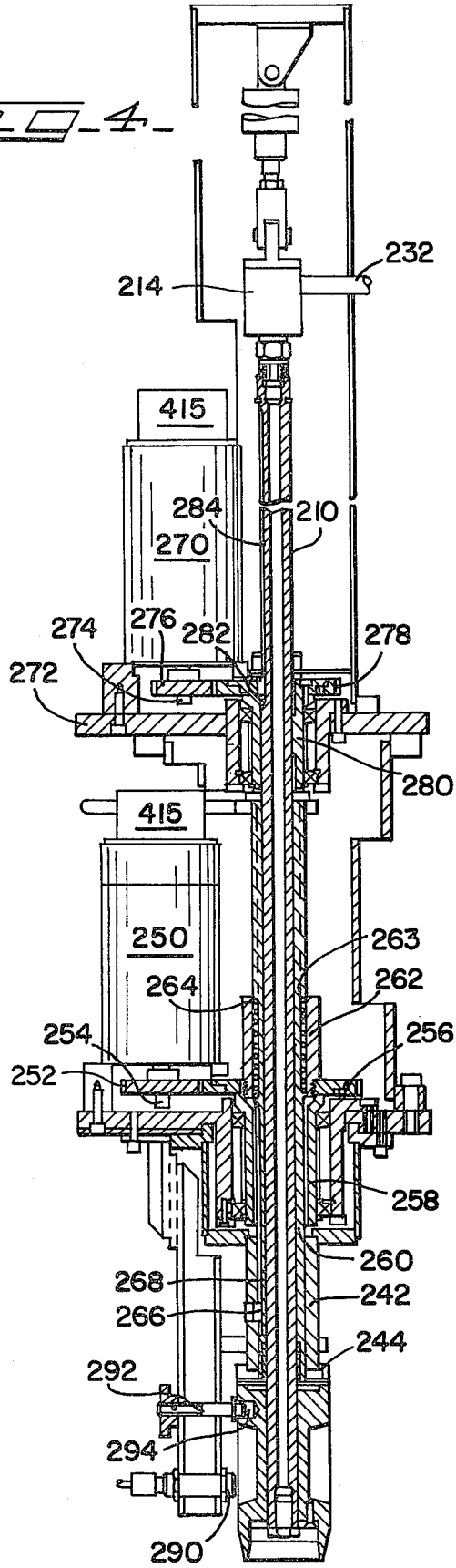

140
124
94
91
92
90
96
142
104
134
26
8
116
8
100
102
134
98
138
139
132
130
C
P
144
24

CONTAINER DEFECT MONITORING SYSTEM

DESCRIPTION

1. Technical Field

The present invention relates generally to monitoring systems and, more particularly, to a system for detecting incorrect colors and other visible defects on the surface of containers, such as drawn and ironed containers.

2. Background Prior Art

In the manufacture of containers for packaging products, such as beer or beverages, numerous steps are necessary to produce the finished container. The most common type of container for beer and beverages in existence today is what is known as a two-piece container formed from a circular blank that is initially deformed into a cup and then is reformed through a drawing and ironing process to produce a thin side wall having an integral end wall which is normally domed inwardly. The drawn and ironed container then is usually trimmed to remove the uneven free edge and is washed. A label is then applied and is baked to cure the label. An inside coating is applied to the inner surface which is then cured by baking. The container is necked inwardly at the open end and an outwardly directed flange is formed on the necked end portion for use in attaching an end thereto after the container has been filled with the product. Lubricants are utilized during the drawing and ironing process and thus require the container to be washed to remove these undesirable lubricants. During the forming of the finished container, including the label thereon, numerous visible defects may occur, such as incorrect coloring, a defective coating, varnish smears, ink splatters, grease pick-up and overbaking. Any such defects detract from the appearance of the finished container or affect the product that is packaged.

As far as is presently known, no system has been developed for automatically detecting incorrect colors and other visible defects on containers, and the present inspection for such defects is performed visually by an inspector. Thus, there remains a need for an automatic inspection apparatus which is capable of detecting visual defects and automatically ejecting containers having such defects.

SUMMARY OF THE INVENTION

According to the present invention, a method of inspecting articles for defects has been developed which is capable of inspecting finished containers selected randomly from a moving path of containers and automatically ejecting a selected container which has defects or returning the inspected container having no defects to the moving path of containers.

More specifically, the inspection apparatus is capable of removing an article from a path of moving articles, picking up the selected article with a pick-up unit and moving the pick-up unit in a first direction to align a preselected plane of the article with a monitoring device and then moving the pick-up unit in an angular orientation to index a preselected point on the selected plane with the monitoring device and producing an output signal indicative of the condition of the article at the preselected point.

According to one aspect of the invention, the apparatus for moving articles from the moving path comprises a first member reciprocable transversely of the path and a second member extending parallel to the first member with means between the members for simultaneously causing movement in opposite directions to simultaneously remove one article from the path while returning a previously removed article back to the path.

The detection system includes an electronic control system consisting of a container support, a color sensor for testing selected containers supported on the support and providing respective outputs representative of the colors on the tested containers with photoelectric scanners for sensing the amount of reflectivity from a container. First and second stepper motors are used for driving the support and are energizable by a programmable control means responsive to decision rules for selecting a reference point on the periphery of the selected container and then moving the container from said reference point to a selected area on the container for enabling the color sensor to inspect the color on the selected area.

BRIEF DESCRIPTION OF SEVERAL VIEWS OF DRAWINGS

FIG. 3 is a view partly in section, as viewed along line 3—3 of FIG. 1;

FIG. 4 is a view similar to FIG. 3, showing further details of the apparatus;

DETAILED DESCRIPTION

Figure 1:
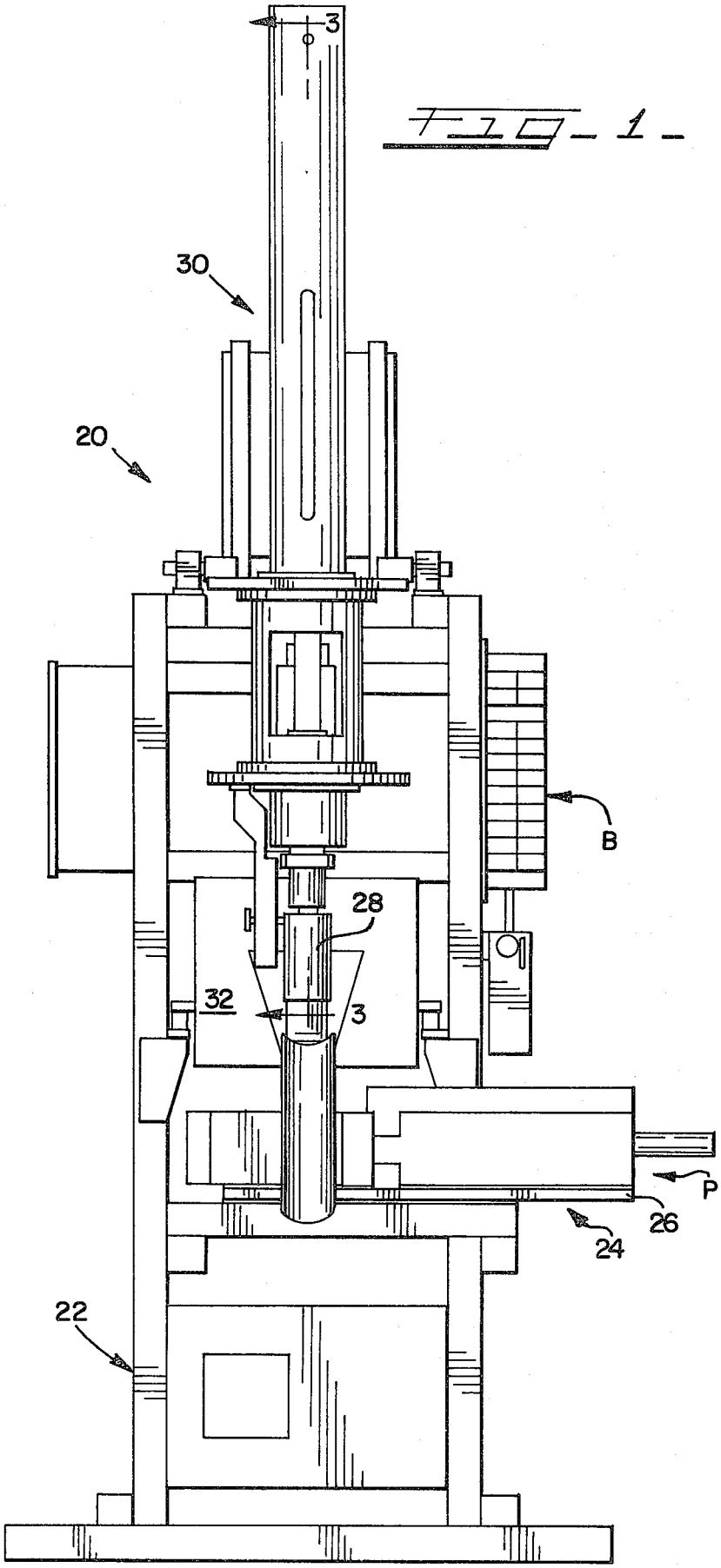
FIG. 1 is a front elevation view of the color monitoring device constructed in accordance with the present invention.

While this invention is susceptible of embodiment in many different forms, there is shown in the drawings and will herein be described in detail a preferred embodiment of the invention, with the understanding that the present disclosure is to be considered as an exemplification of the principles of the invention and is not intended to limit the invention to the embodiment illustrated.

Figure 2:
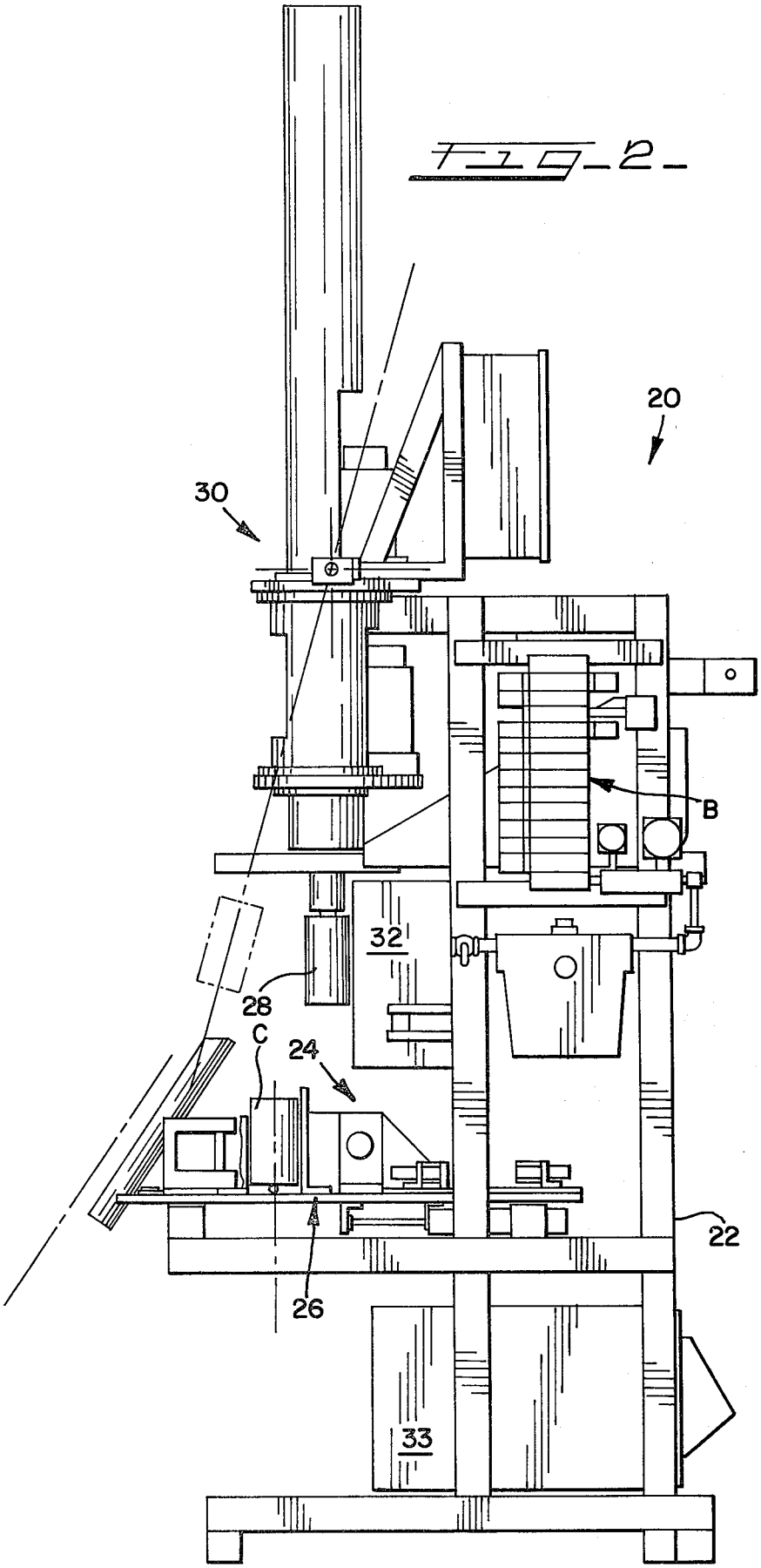
FIG. 2 is a side elevational view similar to FIG. 1.

FIGS. 1 and 2 of the drawings disclose a monitoring unit generally designated by reference numeral 20, comprising a framework or support 22 positioned along one side of a path P of moving containers C. A shuttle mechanism 24 is supported on a horizontal support structure 26, which forms part of the framework 22 and extends transversely across the path P of the moving containers. The shuttle mechanism will be described in further detail later.

Shuttle mechanism 24 is operated to remove a container C at random from the path of moving containers and align the selected container with an arbor 28 supported on the lower end of a locating or indexing unit, generally designated by reference numeral 30. The indexing unit or mechanism 30 is designed to pick up the container adjacent the one side of the path of moving containers, raise the container into general alignment with a color monitoring unit, generally designated by reference numeral 32, and then accurately position a preselected point on the container with respect to the color monitoring unit or colorimeter 32, as will be explained.

Color monitor or sensor 32 may be of any suitable known type and in a preferred embodiment of the invention, the monitor is an XL-23 Colorimeter, manufactured by Gardner Laboratory, Inc., Bethesda, Md. The foregoing colorimeter measures colors and assigns a number to the measurement which is consistent with the visual assessment of color. The colorimeter includes an optical sensing system and a computer 33 for computation and data manipulation.

SHUTTLE MECHANISM

Figure 5:
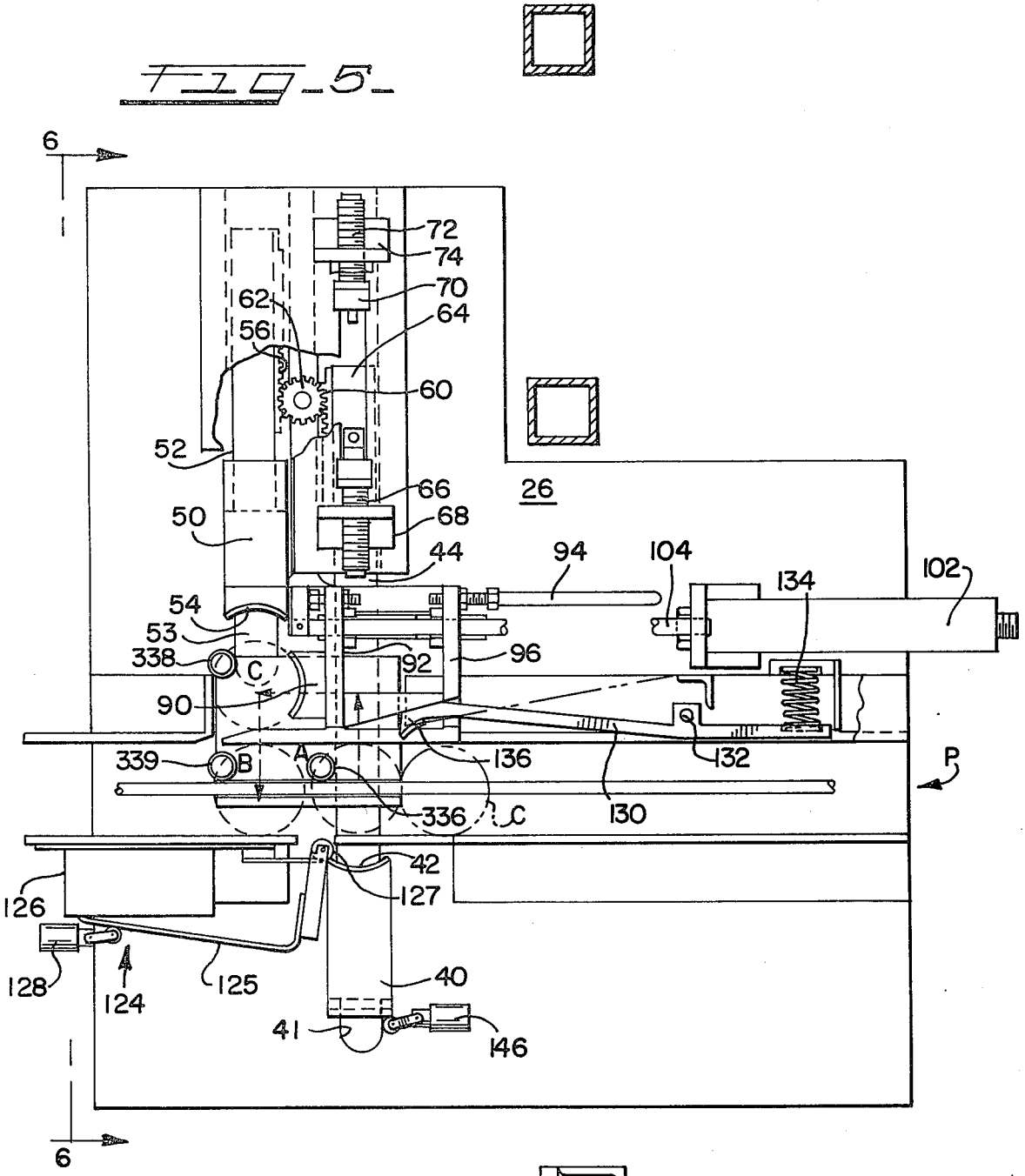
FIG. 5 is an enlarged plan view of the container shuttle mechanism.

The shuttle mechanism 24 is shown in further detail in FIGS. 5–9 and is designed to remove a selected container from the path P, while restraining movement of the succeeding containers, and simultaneously return a previously inspected container to the path for subsequent processing. As illustrated in FIG. 5, the shuttle mechanism includes a first member 40 that is reciprocable transversely on the path P in a slot 41 in horizontal support 26. Member 40 has an elongated body portion 44 reciprocated in slot 41 located below the path P of the moving containers and has arcuate abutment surface 42 moved therewith. A second member 50 extends parallel to the member 40 and again has an elongated body portion 52 guided in a slot 53 located below the lower edge of the containers moving along the path and has an arcuate surface 54.

Shuttle members 40 and 50 are designed to be simultaneously reciprocated in opposite directions. For this purpose, member 50 has a gear rack 56 fixedly secured thereto, while member 40 has an adjustable gear rack 60 supported thereon. A gear pinion 62 is supported for rotation on frame 26 and is in constant mesh with both racks 56 and 60. As clearly shown in FIG. 5, the gear rack 60 is supported on a member 64 which has an adjustment screw 66 at one end thereof threadedly received into an opening in a bracket 68 secured to elongated member 44. A shock absorbing, adjustable position stop 70 is supported on a threaded member 72 extending through an opening in a bracket 74 that is fixed to base 26. Stop 70 may be utilized to accurately position a container, as will be explained below.

Figure 6:
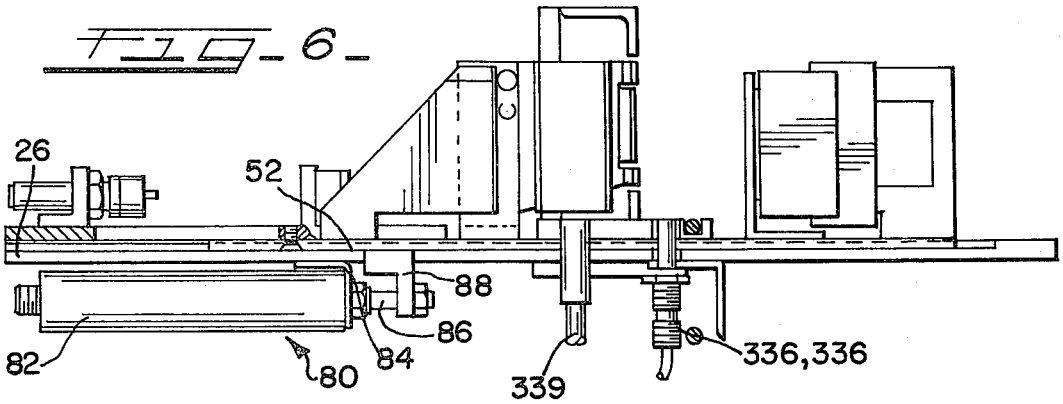
FIG. 6 is an end view, as viewed along ine 6—6 of FIG. 5.

Shuttle members 40 and 50 are simultaneously reciprocated utilizing a single fluid ram 80 which includes a cylinder 82 supported on a bracket 84 secured to frame 26 and a piston rod 86 having its free end connected to a bracket 88 fixed to elongated member 52 (see FIG. 6). Thus, extension and retraction of fluid ram 80 through pneumatic means will move members 40 and 50 from the position illustrated in FIG. 5 to the position illustrated in FIG. 7 so that a container is removed from the path while a previously inspected container is simultaneously returned to the path.

Figure 7:
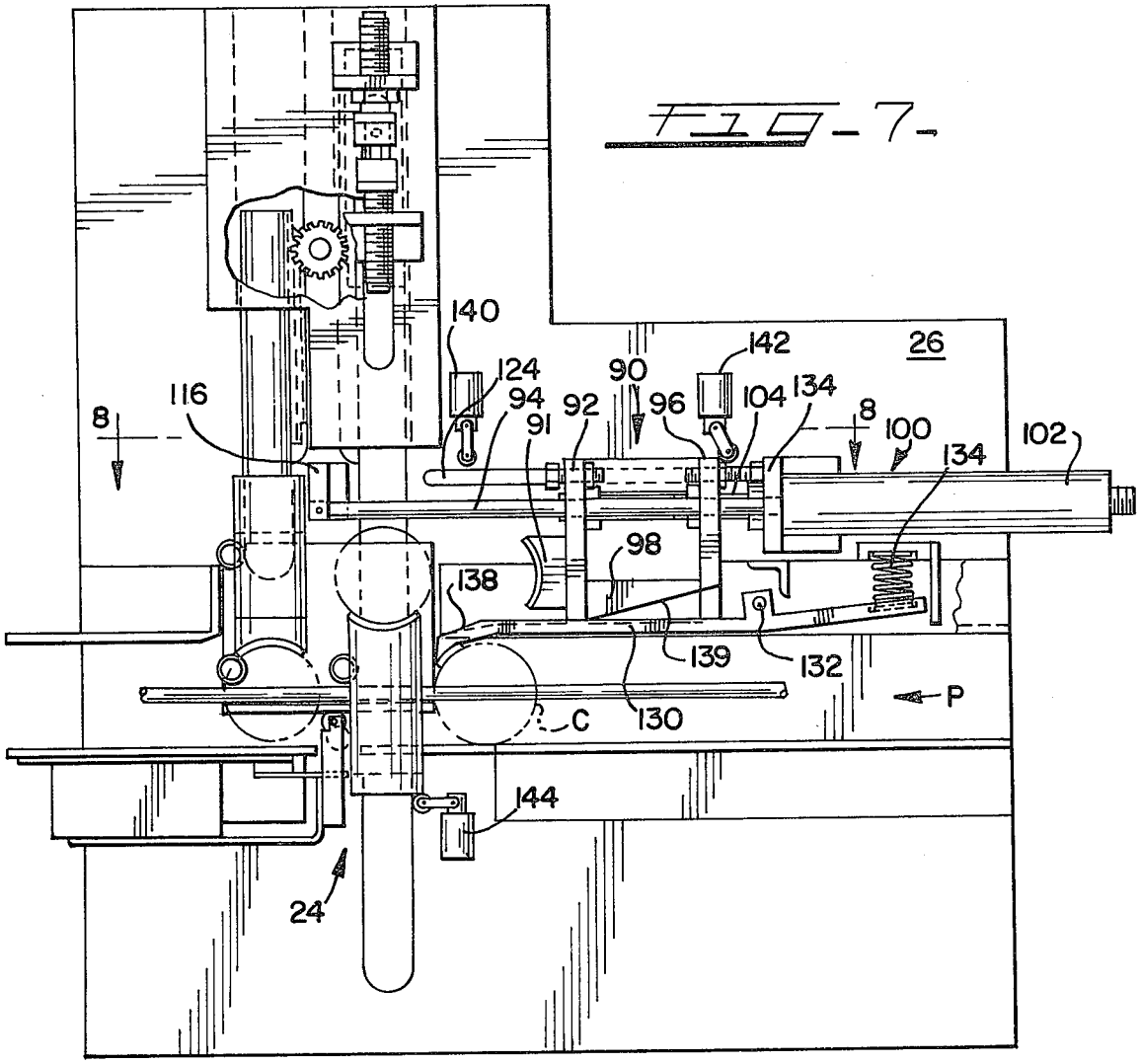
FIG. 7 is a view similar to FIG. 5, showing the shuttle mechanism in a second position.
Figure 8:
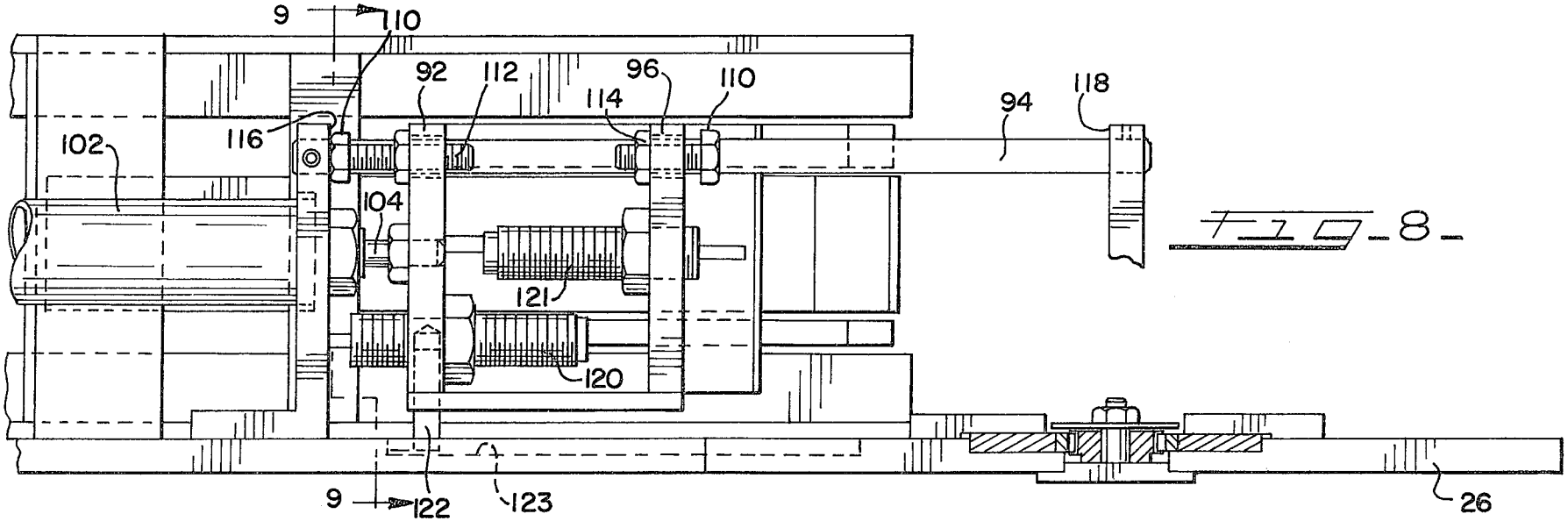
FIG. 8 is a sectional view, as viewed along ine 8—8 of FIG. 7.

After a container C has been removed from the path by member or shuttle 40, it must be moved into vertical alignment with arbor 28. For this purpose, a further shuttle member or carriage 90 is designed to reciprocate along a path generally parallel to the path P of the moving containers and perpendicular to the reciprocable motion of members 40 and 50. As illustrated in FIGS. 7 and 8, carriage 90 includes a member 91 which is supported on a guide plate 92 that is guided for reciprocal movement on a rod 94. A second guide plate 96 is also guided on rod 94 and a camming member 98 is secured between plates 92 and 96. A fluid ram 100 is utilized to reciprocate carriage 90 and includes a cylinder 102 secured to frame 26 and a piston rod 104 connected to plate 96.

As shown in more detail in FIG. 8, plates 92 and 96 respectively have adjustable limit stops 110 supported thereon. Each limit stop 110 is in the form of a screw 112 extending through an opening in either plate 92 or 96 with a lock nut 114 defining the adjusted position of the limit stop 110. The limit stops 110 are aligned with abutments 116 and 118 located at opposite ends of guide rod 94 and also define the support for guide rod 94 on the base 26. Shock absorbers 120 and 121 are respectively adjustably supported on plates 92 and 96. Suitable limit switches 140 and 142 are utilized to feed control signals to a computer which activates selected solenoid-operated valves located in a bank of valve B.

Figure 9:
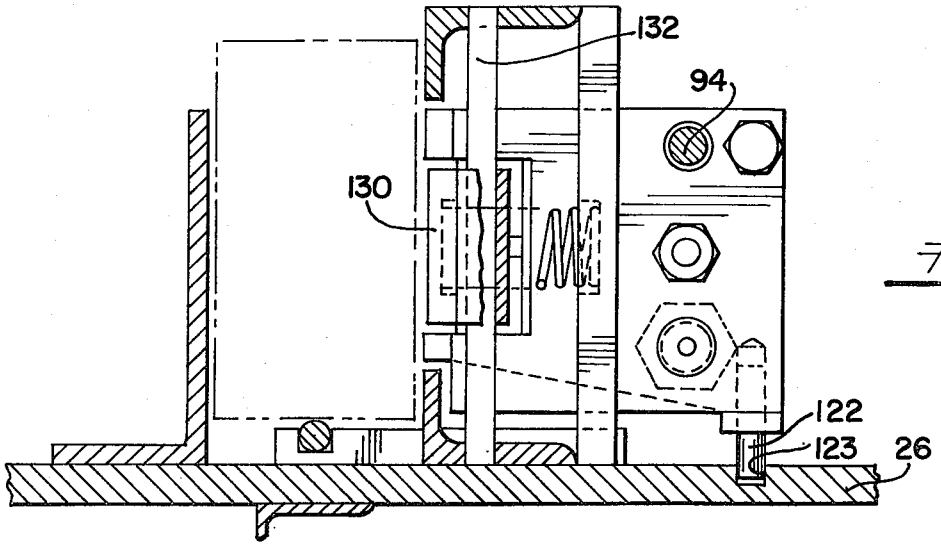
FIG. 9 is a fragmentary cross-sectional view, as viewed along line 9—9 of FIG. 8.

As illustrated in FIGS. 8 and 9, the carriage 90 is guided for movement on base 26 through a pin 122 carried by plate 92 and received in a slot 123 in frame 26. Shuttle member 90 and plates 92 and 96 are thus moved between extreme positions by supplying pneumatic fluid to opposite ends of cylinder 102.

A can stop mechanism 124 is located adjacent the path to temporarily interrupt the movement of the containers along the path while a container is being removed and a previously inspected container is returned to the path. Can stop mechanism 124 is illustrated in FIG. 5 and includes an arm 125 supported on a member 126 that includes an electromagnet. Arm 125 has a roller 127 on its free end and a limit switch 128 associated therewith. Further limit switches 144 and 146 are also located in the path of movement of shuttle member 40.

According to a further aspect of the invention, shuttle mechanism 24 also includes a stop member for interrupting the movement of the containers along the path P while a container is being removed therefrom. As illustrated in FIGS. 7 and 9, an arm 130 is pivoted intermediate opposite ends on a pin 132 extending above base 26. The arm 130 is normally biased to a first position illustrated in FIG. 5 through a spring 134. The opposite end of arm 130 has a stop member 136 which is offset to one side of the path when the arm is in the first position illustrated in FIG. 5. The rear surface of the stop member has a camming surface 138 which cooperates with camming surface 139 located on camming member 98. Thus, as shuttle member 90 is moved from the extended position illustrated in FIG. 5 to the retracted position illustrated in FIG. 7, stop member 136 is moved from the position illustrated in FIG. 5, located outside the path of the moving container, to a position in the path of the moving containers to hold succeeding containers C (FIG. 8) while a container is moved out of the path.

Assuming the shuttle mechanism 24 is in the position illustrated in FIG. 5, the electromagnet in member 126 is activated to produce an electromagnetic field and pull arm 125 from the solid line to the solid line position in FIG. 7. When arm 125 is in this position, limit switch 128 provides a signal to the computer and pressurized fluid is supplied to the rod end of cylinder 102 to retract shuttle member 90 and move stop 136 into path P. The computer then activates a valve in valve bank B to supply pressurized fluid to the head end of cylinder 82 to simultaneously reciprocate members 40 and 50 to remove a container C from the path and return a previously inspected container to path P. At the end of the stroke of shuttle 50, the computer activates a valve in bank B to supply pressurized fluid to the head end of cylinder 102 to move the aligned container parallel to the path P into alignment with arbor 28 ready for pick-up by indexing unit 30.

INDEXING MECHANISM

The indexing mechanism for picking up a container aligned with arbor 28 and accurately positioning a preselected point of container C with respect to a reference point in colorimeter 32 is illustrated in FIGS. 3 and 4. As illustrated in FIG. 3, arbor 28 is connected to a shaft 210 which extends through an elongated housing 212 and is connected at its upper end to a swivel joint 214.

Swivel joint 214, in turn, is connected by a clevis 216 to a piston rod 218 reciprocated within a fluid cylinder 220, which defines the fluid ram means for reciprocating the elongated shaft axially of the aligned container. Cylinder 220 has its head end pivoted on a bracket 222 fixed to housing 212. Thus, to pick up a container, pneumatic fluid is supplied to the head end of cylinder 220 to extend shaft 210 and arbor 28 into a container (not shown in FIG. 3). Once the arbor 28 is in the container, a vacuum is applied to a central opening 230 in shaft 210 through conduit 232 and swivel joint 214. The applied vacuum securely maintains the container in a fixed position on arbor 28.

Pneumatic fluid is then supplied to the rod end of cylinder 220 to axially move the container and arbor 28 to a fully-retracted position, illustrated in FIGS. 3 and 4. In this position, the upper edge of the arbor is in contacting engagement with an annular ring 240 secured to the lower end of a sleeve 242 surrounding shaft 210. A sensor 244, located on ring 240, gives an indication that the arbor is in the fully-retracted position. In this position, the container is in general alignment with the colorimeter 32 and is then pivoted toward colorimeter sensor 32 by mechanism to be described later.

After the container has been generally positioned in the position illustrated in FIGS. 3 and 4, a preselected horizontal reference plane is then aligned with the fixed reference point on the colorimeter. The first adjustment that is made is an axial movement of the container to accurately align the selected reference plane with the fixed reference point, while preventing rotation of the container. This is accomplished by a stepper motor 250 which has a gear 252 on an output shaft 254. Gear 252 is in constant mesh with an annular gear 256 that is supported on a sleeve 258 which surrounds sleeve 260. A nut 262 is carried by the sleeve 258 and gear 256 and has an internal thread 263. The internal thread 263 meshes with an external thread 264 on the upper end of sleeve 260. Rotation of the sleeve 260 is prevented by a key 266 which is received into a slot 268 defined along one side of the sleeve 242.

Stepper motor 250 is designed to rotate gear 256 a small increment for each step of movement. By way of example and not of limitation, stepper motor 250 has four hundred incremental movements or steps during one revolution of movement of output shaft 254 which moves sleeve 260 axially of output shaft 254. During axial movement of the sleeve 260, rotation of the sleeve is prevented by key 266 sliding along slot 268. Also, during such axial movement, contact between the upper end of arbor 28 and the lower surface of ring 240 is assured by maintaining pressurized fluid in the rod end of cylinder 220. The rotary movement of gear 256 thus is translated into axial movement of sleeve 260 to accurately position a preselected annular plane of container C with respect to one of three photoelectric scanners, to be described later.

Once a preselected horizontal plane has been selected for monitoring, a preselected point on the horizontal plane of the container is selected and the container is rotated to move this preselected point into alignment with the selected photoelectric scanner. This is accomplished by a stepper motor 270 supported on a platform 272, which is part of housing 212. Stepper motor 270 has an output shaft 274 and a gear 276 which is in mesh with a gear 278 carried by a collar 280. Collar 280 has an internal key 282 on the inner surface thereof which is received in an elongated slot 284 in the upper end of shaft 210. Thus, rotation of gears 276 and 278 will rotate shaft 284 and the arbor to move a selected point of the horizontal plane into alignment with the selected photoelectric scanner. During such rotation, contact between arbor 28 and ring 240 is maintained by maintaining pressure in the rod end of cylinder 220.

Again, the motor moves in small increments of angular movement of the shaft. By way of example, the stepper motor is designed to have four hundred increments of movement for each 360° of rotation from output shaft 274. Stepper motor 270 is also accurately controlled by a control system that will be described later. The controls for operation of stepper motor 270 to properly align an angular reference point on the can with the selected photoelectric scanner (that is, angularly indexing the can) will be described hereinbelow.

The unit also includes a sensor 290 used to indicate whether a container is present on the arbor and a safety plunger or screw 292 aligned with an opening 294 in arbor 28. Screw 292 is normally maintained in a retracted position and is extended into opening 294, when pressurized fluid is not available to prevent shaft 210 from dropping when pressurized fluid is lost.

The inspection unit also includes an ejector mechanism for removing any containers from the system which do not meet with minimum requirements, as will be set forth later. The manner of ejecting defective containers is more clearly illustrated in FIGS. 10 and 11. As shown therein, housing 212 is pivoted about a generally horizontal pivot axis 300 on frame 22 and has an arm 302 extending therefrom at a location spaced from pivot axis 300. A fluid ram 304 has the head end of a cylinder 306 pivotally connected to a bracket 308 on frame 22, while piston rod 310 is connected by a pin 312 to arm 302.

Figure 10:
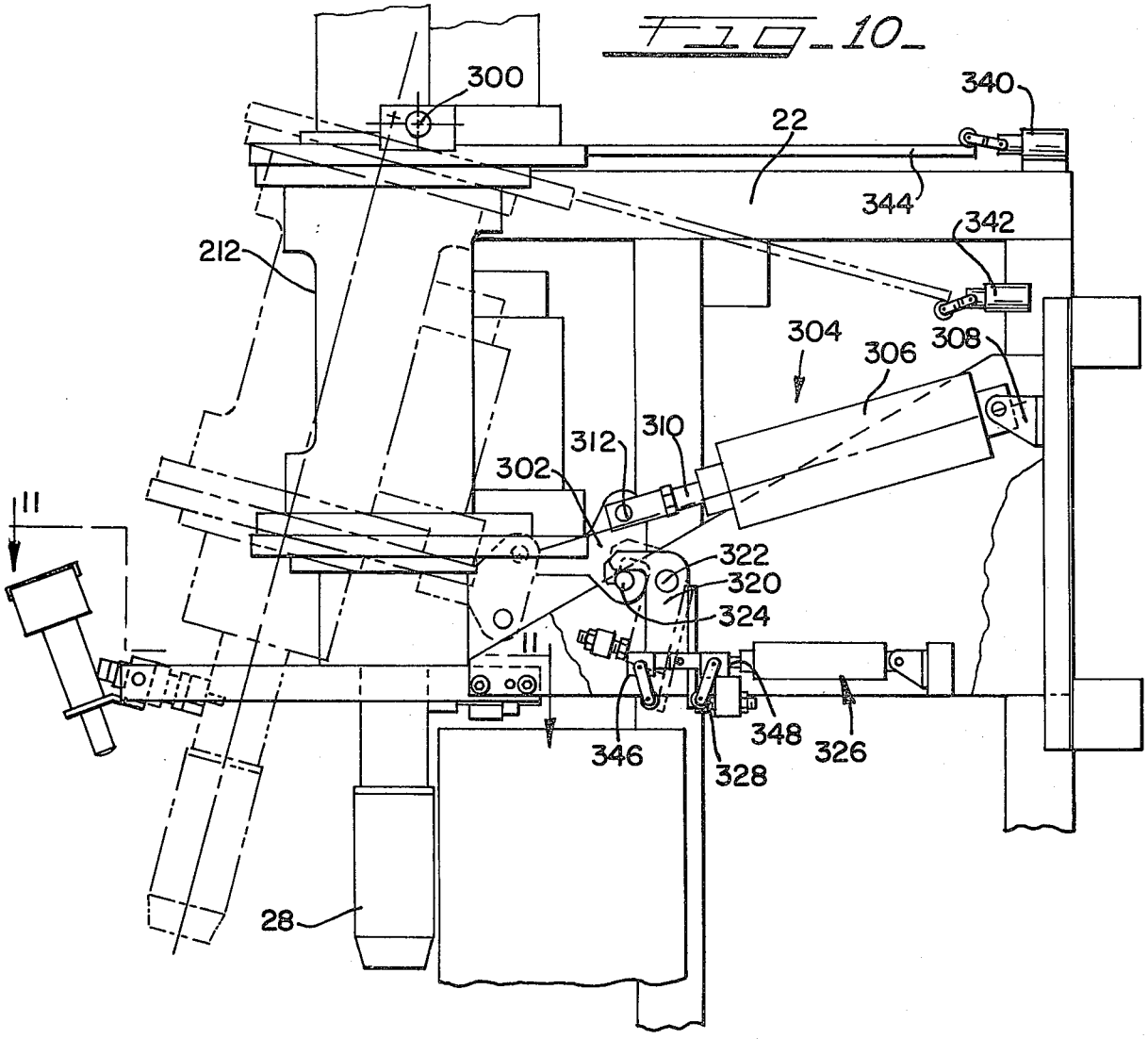
FIG. 10 is an enlarged fragmentary view of the ejector mechanism, showing the unit in two positions.
Figure 11:
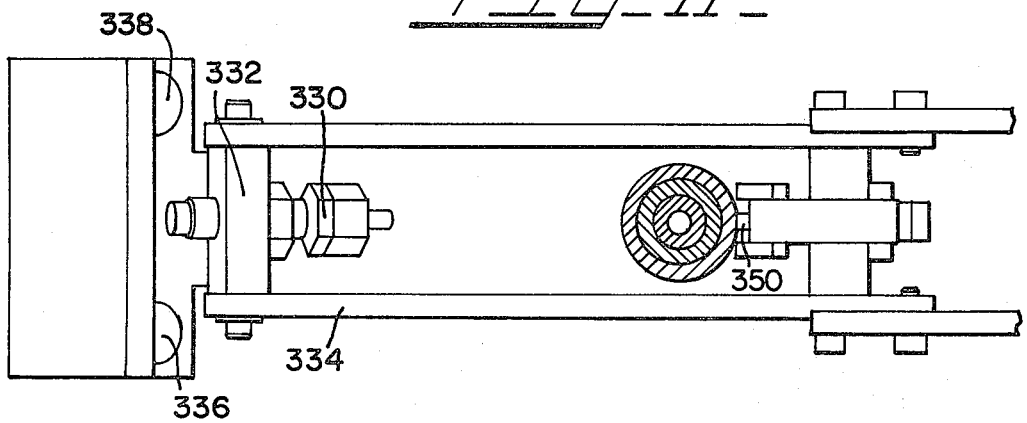
FIG. 11 is a fragmentary cross-sectional view, as viewed along line 11—11 of FIG. 10.

The ejector mechanism also has a locking latch which cooperates with arm 302. As shown in FIG. 10, the latching mechanism consists of a generally L-shaped crank 320 which is pivoted about a pin 322 on frame 22. The upper free end of the latch cooperates with a pin 324 on arm 302. Crank 320 is pivoted above pin 322 by a fluid ram 326. An adjustable stop 328 is provided to define the first latched position for crank or latch 320. Thus, when a defective can is encountered, a signal is sent to bank B of solenoid-operated valves to first supply pressurized fluid to fluid ram 304 and pivot the unit counter-clockwise, as viewed in FIG. 10. Pressurized fluid is then supplied to the head end of fluid ram 326 to unlatch the arm 302 and then a signal is sent to another valve to supply pneumatic fluid to the head end of cylinder 306 and move the entire indexing unit from the solid line position to the dotted line position, illustrated in FIG. 10. The dotted line or eject position is defined by a stop member or shock absorber 330 which is supported on a cross member 332 extending between the outer ends of a pair of arms 334 which form part of the frame 22.

The system also incorporates a mechanism to accurately position the spacing between arbor 28 with a container on it and the colorimeter 32. While a container is being picked up and removed, pressurized fluid is maintained on the head end of fluid ram 304 to maintain pin 324 in engagement with latch 320. In this position, shown in FIG. 11, the arbor 28 is spaced a small distance from an adjustable stop 350.

When color readings are to commence, pressurized fluid is supplied to the rod end of the fluid ram to move the arbor and container into engagement with stop 350 and accurately position the container with respect to colorimeter 32.

Two light sensor 336 and 338 are also supported on cross member 332. Sensor 336 is used to provide a signal to the computer that a container is in position to be removed from the path while sensor 338 senses whether a container is in the path P occupying the position to which tested containers are normally returned. This prevents the computer from returning a second container while a container is present in the path P. A third sensor 339 (FIG. 5) senses when an inspected container is present in the transfer area. Limit switches 340 and 342 cooperate with an arm 344 and provide feedback signals to indicate the position of the unit while limit switches 346 and 348 provide feedback signals to indicate the position of the latch 320.

CONTROL SYSTEM

Figure 12:
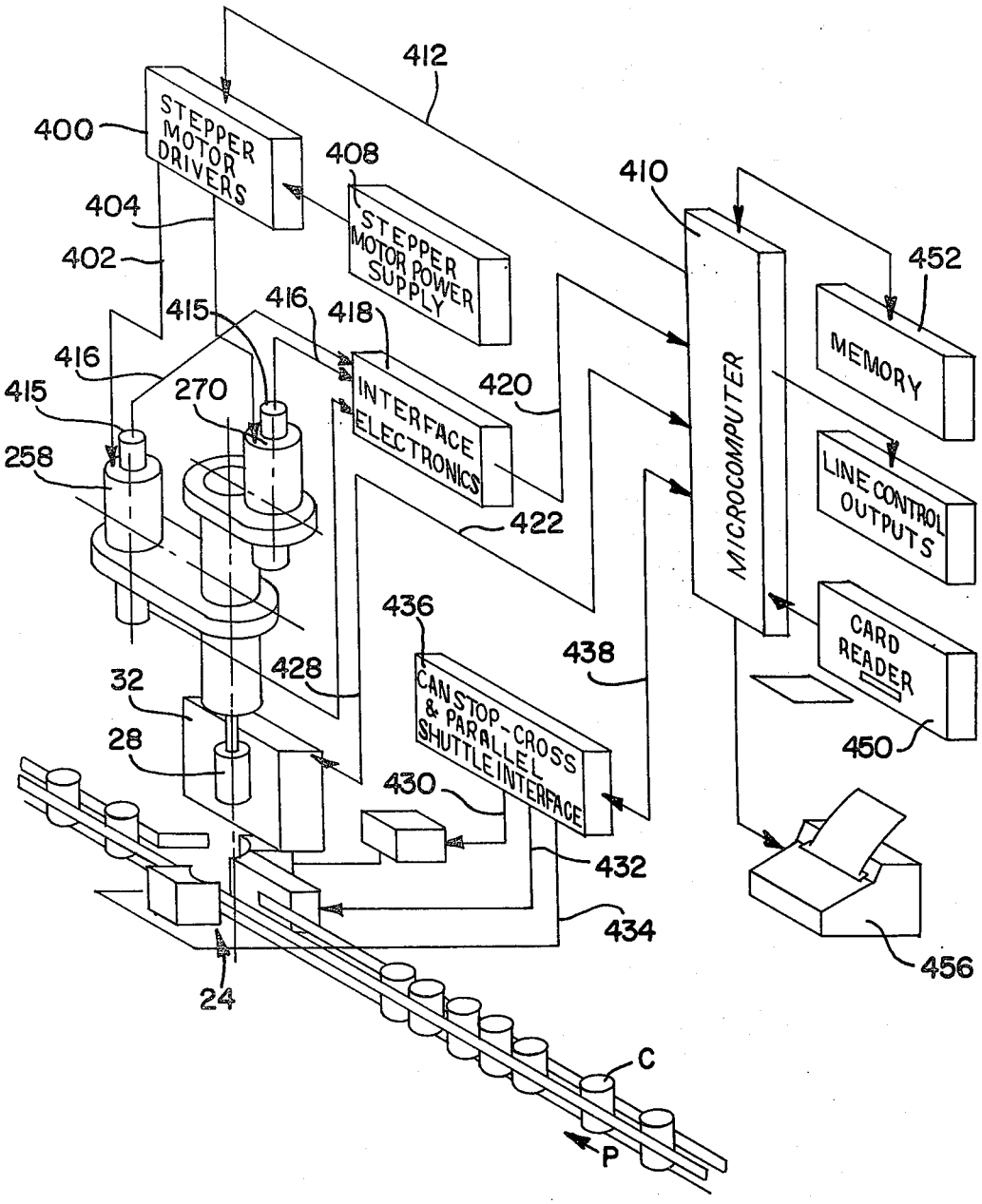
FIG. 12 is a schematic illustration of the color monitoring unit.
Figure 13:
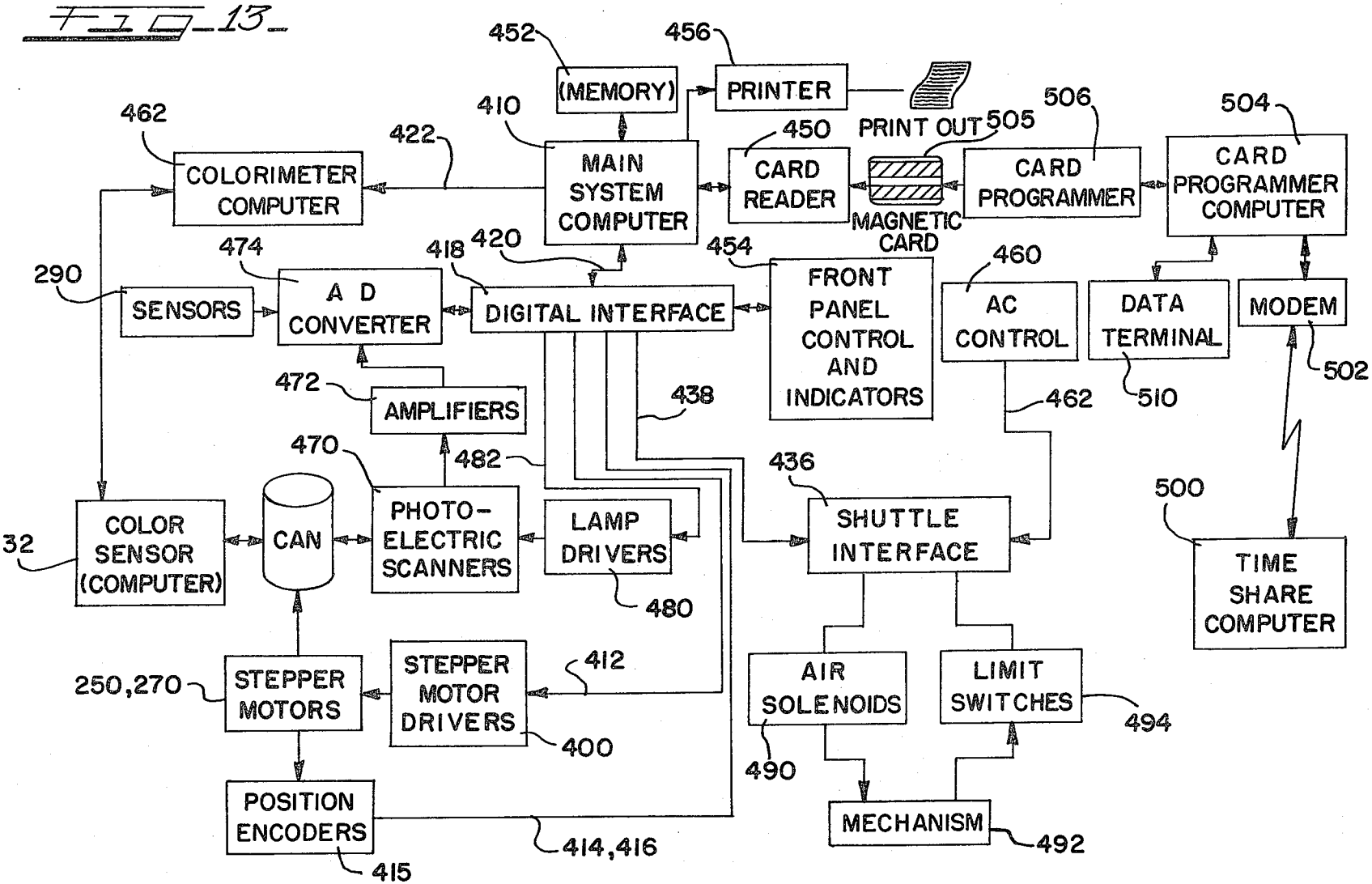
FIG. 13 is a schematic electrical block diagram of the monitor control system.

FIGS. 12 and 13 schematically illustrate the control system for controlling all motions of the mechanism. As illustrated, stepper motors 250 and 270 are connected to stepper motor drivers 400 through lines 402 and 404. Power is supplied to stepper motor drivers 400 through a power supply 408. Stepper motor drivers 400 are controlled through a main system computer 410 which is connected to the motor drivers through a line 412. Signals from position encoders 415 (FIG. 13) indicating the position of each of the stepper motors 250 and 270 are fed through lines generally labeled 416 to digital interface 418 and line 420 to the main system computer 410. The colorimeter 32 is also connected to the computer 410 through a line 422.

Note that FIGS. 12 and 13 are essentially single line drawings and each line may represent electronic cabling which may comprise various numbers of electrical connections.

FIG. 13 discloses in further detail in block diagram the electronic control system that controls all of the functions of the inspection apparatus. As illustrated therein, colorimeter 32 comprises a color sensor and computer which produce a digital output representative of the color being monitored through line 422 to main computer 410.

The control system incorporates means for producing signals indicative of the condition or position of the container so that an appropriate reference point can be selected for a given label. For this purpose, the control circuit incorporates photoelectric scanners 470 which are capable of scanning the container while it is being rotated by stepper motor 270. Scanners 470 are driven by lamp drivers 480 connected by line 482 to the digital interface 418.

For purposes of simplifying the drawing of FIG. 12, the photoelectric scanners 470, lamp drivers 480, the amplifiers 472, A/D converter 474, sensors 290 and the digital interface 418 of FIG. 13 are indicated in FIG. 12 as the block interface electronics 418.

Scanners 470 produce analog output signals and the output of the scanners is amplified in an amplifier 472 and fed to an analog-to-digital converter 474. The analog-to-digital converter 474 produces a digital output which is fed through digital interface 418 and line 420 to main system computer 410. Analog-to-digital converter 474 also receives signals from various sensors 290 indicating various conditions. For example, the sensors (not shown) may indicate the condition of the pressurized pneumatic and vacuum source, arbor internal pressure, reference voltage, colorimeter lamp brightness and computer temperature.

In the embodiment shown, the electronic control system of FIGS. 12 and 13 is designed to receive information from a central computer 500 and encode this information onto a magnetic card. The computer 500 provides necessary programming data to enable inspection of the various containers having various types of labels and color patterns. The data from computer 500 is coupled, via a telephone modem 502, to a card programmer computer 504. The computer 500 may be a time-shared computer, located at a central point, such as a corporate headquarters, and connected by telephone line to one or more plants remotely located from the computer. The card program computer 504 located at a plant site energizes a card programmer 506 to program a magnetic card 505 with the selected program data from the computer 500. The card reader 450 reads the particular magnetic card and enters the required program into the main system computer for a given container and container label. The card programmer computer 504 may also provide an output to a data terminal 510 to store data at a local point for future use.

The shuttle interface 436, which is also the interface for all of the mechanical functions, except the stepper motors and encoders, receives an AC input from an AC control unit 460 through line 462. The interface 436 is connected to numerous electrically-actuated solenoids 490 which control movement of solenoid-operated valves located in the bank of valves B shown in FIG. 1. These solenoids are actuated to operate the control mechanism, generally designated by reference numeral 492, and indications of the position of the mechanical mechanism are fed back through suitable limit switches 494 as a control function to the interface 436.

As stated above, the color sensor 32 analyzes and evaluates the colors on each can to determine whether the colors are of the correct hue and brightness. Cans usually have various colors and various color patterns printed or deposited thereon, and a first step in monitoring the colors on a can is to determine a reference point to function as the base for making the measurements. As will be apparent, the bottom and top of the cans provide accurate references from which to base the desired height position of the can. Positioning of the can at the desired height is accomplished by the arbor 28 and stepper motor 250, as described above.

Once the can is positioned at the desired height, an angular or circumferential reference point for the can must be determined. Initially, each can type is analyzed visually and a reference point on the color pattern of the can type is selected. The reference point is unique; that is, as the can is rotated on a fixed base at a fixed height, there is only one point along a line on its circumference of that particular color pattern. For example, in one particular can type, the color pattern was duplicated on the circumference of the can and the only area having a unique (non-duplicated) color pattern was the space occupied by the Universal Packaging Code (UPC) symbol. Once the unique reference point is selected for a can type, this data is entered into the time-shared computer to become an integral part of the test program for that can type.

As may be appreciated from FIG. 12, as the cans move down the conveyor line, they are in random angular position. Assume now that a can is removed from the conveyor line and moved into the inspection area. As described above, the arbor picks up a can from the line and positions the can at a selected height with respect to any one of these photoelectric scanners 470.

Refer to FIG. 13 for a description of the angular positioning subsystem, which includes three photoelectric scanners or optical scanners, with each scanner having a different color light sensor therein and its own light source. The lights provided by each source reflect off the can and back into the photoelectric sensors, through three different color filters, one being responsive to red, one to yellow and one to green or blue. The signals are then sensed by a phototransistor, amplified and then coupled to the A/D converter 474.

The reference point on the can is selected in accordance with a specified decision rule for each can type; that is, the decision rule is the programmed criteria which is used to make the operating decisions. Different decision rules have been formulated to accommodate the color patterns on different types of cans. One rule requires the scanner to look for a number of consecutive measurements for which the light reflected exceeds an average; and, when that occurs, the system notes that the can is at a selected reference, as will now be explained.

As mentioned, the can is initially positioned by the arbor 28 and stepper motor 250 at a selected height respective to one of the optical sensors but with no specific angle orientation; that is, the point or area of the can facing the optical sensors and the photoelectric scanners 470 is completely arbitrary. Once the can is at the desired height, the stepper motor 270 is energized to rotate the can 360° in four hundred steps. Each step position of the can is evaluated; that is, the light reflected at that position of the can is measured by the photoelectric scanners 470. The average output of reflected light from a complete rotation of the can is determined. The stepper motor 270 then initiates a second cycle of rotation. In one embodiment, the decision rule utilized requires that the light reflected through $50\pm3$ consecutive steps be greater than the average output of reflected light during the initial revolution of the can. When the output from each of the fifty steps is above the average, the computer registers this event and triggers activity to establish the termination of the fiftieth step as a unique reference point on the can which will serve as a reference for color monitoring.

A height reference point can also be established, if needed, utilizing the same principal after the reference angular point has been established. In some instances, it may not be necessary to determine the average output. For example, one decision rule may require fifty consecutive readings above a certain voltage which will then be the reference point.

After the angular reference is established, and since the height reference is known or has been established, the stepper motors can be energized to selectively rotate and raise or lower the can to a first desired point to take colorimeter readings. After the readings have been taken at the first desired point, the steppers can again raise and lower the can and rotate the can to the next reading point.

BRIEF SUMMARY OF OPERATION

Consider now the operation of the color monitoring unit described above. Initially, power is applied to the system and numerous diagnostic tests are conducted to insure that the system is functioning properly. All limit switches are checked to verify that the mechanism is in the desired starting position. The computer is programmed so that the air, and colorimeter and sensor lamps are tested and the analog-to-digital circuit temperature and reference voltages are checked automatically. In the event a problem exists, a diagnostic message is printed. If all system check out properly, a start button is actuated on front control panel 454 and a read button is actuated to direct the card reader to read a magnetic card and store the data in member 452.

Once all of the data is in the computer, a button is pushed to instruct the computer to begin the automatic sequence of removing cans from the line and testing them. Once the testing is initiated, the computer controls the entire operation automatically, and the sequence is as follows. The computer energizes the electromagnet to pull arm 125 into the path of moving containers which blocks the flow of moving cotainers. Sensor 336 detects when a container is stopped in the transfer position and instructs the computer to activate carriage 90 which retracts and extends stop 136 to hold the trailing containers. The computer than activates shuttle members 40 and 50 to return a previously tested container to the path and remove a new container between arm 125 and stop 136 from that path. The shuttle mechanism, the can stop arm 125 and the carriage 90 all are then returned to their original positions and the computer activates a further solenoid valve in valve bank B to direct fluid to the head end of cylinder 220 to move the arbor to its extended position, placing the arbor inside the new container which has just been isolated. Another valve in bank B is activated to apply a vacuum inside this container, causing it to firmly attach itself to the arbor. Next the computer activates a solenoid valve in valve bank B to direct fluid to the rod end of cylinder 220 and move the arbor from its extended position to a fully-retracted position, illustrated in FIG. 3. When the arbor reaches its fully-retracted position, sensor 244 instructs the computer to begin positioning the container to select a fixed reference point to be presented to one of the scanners 470. This is accomplished by activating stepper motor 250 to axially move arbor 28 to a point where a selected reference plane is aligned with one of the scanners 470. Signals are then fed to stepper motor 270 to rotate the container while scanner 470 scans the selected reference plane and produces output signals which are fed through an analog interface, analog-to-digital converter 474 and digital interface 418 to computer 410. When a selected reference point in the selected annular plane has been located, the main system computer begins the inspection cycle by sending signals to the stepper motors to move the container from the fixed reference point to a selected point that is to be inspected. The printer 456 may be programmed to print the various data to provide a history of the cans being tested.

After all of the selected points on a given container have been inspected and all fall within the prescribed limits, the computer directs the indexing apparatus to return the container to the platform for return to the moving container line. This is accomplished by activating a solenoid to activate a valve in the bank of valves B and supply pressurized fluid to the head end of cylinder 220 and lower the arbor 28. Pressurized fluid is then supplied to internal opening 230 to force the container off the arbor as the arbor is returned to its raised position. The shuttle mechanism is then actuated to return the inspected container to the container line and select a new container for an inspection operation, as was described above.

In the event that the colorimeter 32 produces a signal which is not within a prescribed limit for a given point being inspected, by comparison with the prescribed limits retained in memory 452, the main system computer will then produce an output signal through interface 418 and 436 to activate respective solenoids and initially unlatch the latch member 320 and supply pressurized fluid to cylinder 306 to move the indexing unit 30 to the phantom line position illustrated in FIG. 10 whereupon pressurized fluid is supplied to internal opening 230 to eject the defective container from the arbor 28. The computer also sends a message to printer 456 that prints a message that describes how much and where the color was out of tolerance.

After the ejected container has been removed from the arbor, the indexing mechanism is returned to the solid line position in FIG. 10 in preparation for receipt of another container. At this time, the computer will direct appropriate signals to remove a subsequent container from the path P and repeat the cycle of operation described above.

As can be appreciated from the above description, the present invention provides a unique, completely automated system for monitoring the labels on conventional beer and beverage containers. However, it will be appreciated that the invention is not limited to beer and beverage containers and could have equal applicability to other types of containers, such as bottles. Furthermore, the inspection apparatus is not limited to inspection of colors and can be used for inspection of other defects such as varnish smears, ink splatter, grease pick-up and overbaking of the coatings.

We claim:

1. A monitoring device for inspecting the condition of the surface of articles moving along a path comprising a color monitor positioned adjacent said path, first means for removing an article from said path, second means for positioning said article into general alignment with said color monitor, third means for indexing a preselected point of said surface with respect to said color monitor, said color monitor producing a signal indicative of the condition of said surface at said preselected point, and ejector means for ejecting said article when said signal is outside preselected limits, said first and second means cooperating to return said article to said path when said signal is within said preselected limits, and said first means returning said article to said path and thereafter removing another article from said path, said first means including first and second members reciprocable transversely of said path, means between said members for moving said members in opposite directions with respect to each other, and drive means for reciprocating said members.

2. A monitoring device as defined in claim 1 in which said first means includes means for interrupting movement of a trailing article while said article is being removed from said path.

3. A monitoring device as defined in claim 2 including further means for initially interrupting flow of articles along said path to isolate said article being removed from said path between said further means and said first means.

4. A monitoring device as defined in claim 2, further including means for shifting said article from said first member into alignment with said second member and said second means.

5. A monitoring device as defined in claim 4 in which said means for interrupting movement includes an arm biased to a first position adjacent said path and said means for shifting includes a camming surface engaging said arm and moving said arm into said path when said means for shifting is returned to an initial position.

6. A monitoring device as defined in claim 1 in which said second means includes an elongated shaft having an arbor at one end and fluid ram means for moving said shaft and arbor between raised and lowered positions.

7. A monitoring device as defined in claim 6 in which said third means includes rotating means for rotating said shaft to angularly position said preselected reference point with respect to said color monitor and further means for moving said article axially while preventing angular movement of said article to axially position said preselected reference.

8. A monitoring device as defined in claim 7 in which said further means includes a sleeve surrounding said shaft and having external threads and a threaded nut in mesh with said external threads with means for rotating said nut to axially shift said sleeve and in which said fluid ram means is pressurized to cause said shaft and article to move with said sleeve.

9. A monitoring device as defined in claim 8 in which said sleeve, shaft and nut are pivotally supported as a unit about an axis transverse to said shaft and in which said ejector means includes means for pivoting said unit from a first position to a second position, and means for removing said article in said second position.

10. A method of inspecting articles for defects comprising the steps of removing an article from a moving path of articles, aligning said article with a pick-up unit, operably engaging said article with said pick-up unit, moving said pick-up unit in a first direction to align a selected plane of said article with a monitoring device, rotating said pick-up unit to index a preselected area of said selected plane with said monitoring device, and producing an output signal indicative of the condition of said article at said preselected area.

11. A method as defined in claim 10 including the further steps of returning said article to said path when said output is within preselected limits and simultaneously removing another article from said path for inspection.

12. A method as defined in claim 10 including the further step of ejecting said article when said output signal is beyond preselected limits.

13. A method as defined in claim 12 in which said pick-up unit is pivoted on a support and is pivoted from a first position to a second eject position for ejecting said article.

14. A method as defined in claim 10 in which said article is a container having colored indicia thereon and in which said output signal is indicative of the hue and brightness of the colored indicia at said preselected area.

15. Indexing apparatus for indexing a cylindrical-shaped article with respect to a fixed reference point, comprising a member for supporting said article, first means for raising and lowering said member along an axial direction to vertically align a selected annular plane of said article with said fixed reference point, and second means for rotating said annular plane to align a selected point of said annular plane with said fixed reference point.

16. Indexing apparatus as defined in claim 15 in which said first means includes a fluid ram connected to said member and a support for moving said member to a first position and a stepper motor on said support for incrementally moving said member from said first position.

17. Indexing apparatus as defined in claim 16 in which said second means includes a stepper motor.

18. Indexing apparatus as defined in claim 16 in which said first means includes a hollow shaft between said member and said fluid ram, a sleeve surrounding said shaft and having external threads, a threaded nut having threads in mesh with said external threads, said stepper motor rotating said nut to axially shift said sleeve, and vacuum means connected to said hollow shaft for holding said article on said member.

19. Indexing apparatus as defined in claim 18 in which said second means includes a stepper motor for rotating said shaft, sleeve and nut as a unit.

20. Apparatus as defined in claim 15, further including means for removing articles from a linearly-aligned array of articles moving along a path and returning said articles to said path, said means for removing articles comprising a first member reciprocable transversely of said path, a second reciprocable member extending parallel to said first member, means between said members for causing said members to simultaneously move in opposite directions, and drive means for reciprocating said members to simultaneously remove one article from said path and return a previously removed article to said path.

21. Apparatus as defined in claim 20 including further means for interupting said moving articles and means for isolating a lead article from said linearly-alingned array.

22. A device for removing and inspecting circular articles moving along a path comprising a monitor for sensing a condition of the article, first means for removing an article from said path, second means for positioning said article into general alignment with said monitor, third means for indexing a preselected point of said article with respect to said monitor, said third means including means for axially shifting said article to position a selected plane with respect to said monitor, and means for rotation said article to position a selected point of said plane with respect to said monitor, said monitor producing a signal indicative of the condition of the article at said preselected point, and ejector means for ejecting said article when said signal is outside preselected limits, said first and second means cooperating to return said article to said path when said signal is within said preselected limits.

* * * * *